US007122914B2

(12) United States Patent
Caruthers

(10) Patent No.: US 7,122,914 B2
(45) Date of Patent: Oct. 17, 2006

(54) SYSTEM FOR STARTING AN ELECTRIC DRIVE MACHINE ENGINE

(75) Inventor: Michael Aaron Caruthers, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 115 days.

(21) Appl. No.: 10/740,611

(22) Filed: Dec. 22, 2003

(65) Prior Publication Data

US 2005/0134049 A1 Jun. 23, 2005

(51) Int. Cl.
*F02D 29/06* (2006.01)

(52) U.S. Cl. ..... 290/40 C; 290/40 A; 290/40 B; 180/65.2

(58) Field of Classification Search ..... 290/40 C, 290/40 A, 40 B, 40 R; 180/65.2
See application file for complete search history.

(56) References Cited

U.S. PATENT DOCUMENTS 5,172,006 A * 12/1992 Suzuki et al. ..... 290/45
5,461,289 A * 10/1995 Adler et al. ..... 318/139
5,650,713 A * 7/1997 Takeuchi et al. ..... 322/16
5,705,859 A 1/1998 Karg et al. ..... 290/45
5,788,004 A * 8/1998 Friedmann et al. ..... 180/65.2
6,018,199 A * 1/2000 Shiroyama et al. ..... 290/37 A
6,032,753 A * 3/2000 Yamazaki et al. ..... 180/65.3
6,326,702 B1 * 12/2001 Yonekura et al. ..... 290/40 C
6,364,042 B1 * 4/2002 Joachim ..... 180/65.2
6,373,206 B1 * 4/2002 Morimoto et al. ..... 318/139
6,459,166 B1 * 10/2002 Yanase et al. ..... 290/40 C
6,591,593 B1 7/2003 Brandon et al. ..... 56/10.6

* cited by examiner

*Primary Examiner*—Darren Schuberg
*Assistant Examiner*—Iraj A. Mohandesi
(74) *Attorney, Agent, or Firm*—Finnegan, Henderson, Farabow, Garrett & Dunner

(57) ABSTRACT

A method for starting an engine of an electric drive machine may include the method steps of introducing current to an electric motor system from a battery and receiving the current into at least one coil on an electric motor of the electric motor system. The electric motor may be configured to drive the electric drive machine when operating. The method may also include the steps of releasing the energy from the at least one coil to an energy storage device and discharging the voltage from the energy storage device to a power generation system to start the engine. A system for starting an engine of an electric drive machine is also disclosed.

21 Claims, 4 Drawing Sheets

SYSTEM FOR STARTING AN ELECTRIC DRIVE MACHINE ENGINE

TECHNICAL FIELD

This application is directed to a system and method for starting an engine on an electric drive machine and more particularly, to a system and method for starting an engine using the electric motor of the electric drive machine.

BACKGROUND

Electric drive machines generally include an engine and a generator configured to provide electric power to an electric motor for driving the machine. On large work machines, such as dozers, tractors, and trucks, the electric motors are large and powerful, and the engines are required to provide a substantial amount of power to drive the electric motors. Because of this, the engines are also large and powerful. Starting these engines requires high levels of power.

One typical starting system for these engines includes a starter and a battery. The starter for these engines must be large and robust to turn the engine until it is operating. These starters may be expensive and may be prone to mechanical problems requiring maintenance and expense to keep them operating.

Because the energy required to start these large engines is often higher than the energy offered in a standard battery, some starting systems include a separate power booster to boost the battery power to a level sufficient to start the engine. These power boosters, like the starters, may be expensive and high maintenance.

Another typical starting system includes components that provide energy to the generator attached to the engine to turn the generator until the engine starts. One example of such a system is disclosed in U.S. Pat. No. 5,705,859 to Karg et al. The '859 patent discloses a system for starting an engine that uses a generator to crank the engine until it starts. Voltage is provided to the generator through an intermediate circuit that receives voltage from a battery that is boosted by a transformer. However, the system of the '859 patent still requires extra components to boost the battery power to a level sufficient to start the engine. For example, it requires a rectifier, an intermediate circuit, and a transformer between the battery and the generator.

The present disclosure is directed to overcoming one or more other deficiencies in the prior art. In particular, the present disclosure provides a method and system that reduces the number of components required to start an engine on an electric drive machine.

SUMMARY OF THE INVENTION

In one aspect, the present disclosure is directed to a method for starting an engine of an electric drive machine. The method may include introducing current to an electric motor system from a battery and receiving the current into at least one coil on an electric motor of the electric motor system. The electric motor may be configured to drive the electric drive machine when operating. The method may also include releasing the energy from the at least one coil to an energy storage device and discharging the voltage from the energy storage device to a power generation system to start the engine.

In another aspect, the present disclosure is directed to a system for starting an engine of an electric drive machine. The system may include a power generation system and an electric motor system. The electric motor system may include an electric motor having at least one coil and configured to drive the electric drive machine when operating. The electric motor system may be electrically associated with the power generation system. A battery may be selectively associated with the electric motor system and configured to introduce current to the electric motor system. A controller may be configured to control the release of energy from the at least one coil in the electric motor to an energy storage device. The controller may also be configured to control the discharge of voltage from the energy storage device to the power generation system to start the engine.

DETAILED DESCRIPTION

Reference will now be made in detail to embodiments of the present invention, examples of which are illustrated in the accompanying drawings. Wherever possible, the same reference numbers will be used throughout the drawings to refer to the same or like parts.

Figure 1:
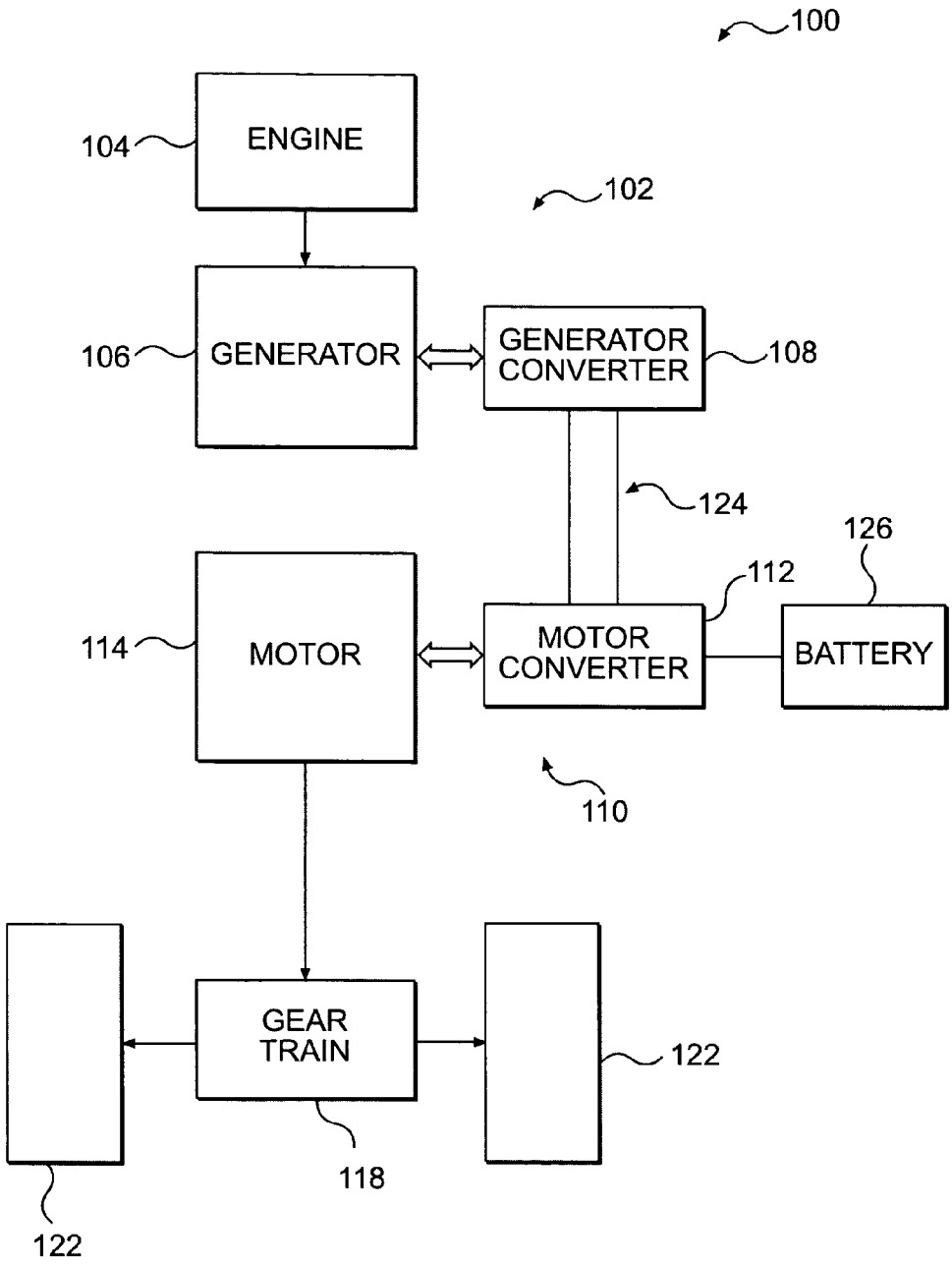
FIG. 1 is a block diagram showing an electric drive machine in accordance with this disclosure.

An exemplary embodiment of an electric drive machine 100 is shown in FIG. 1. The electric drive machine 100 includes a power generation system 102 and an electric motor system 110 for driving a gear train 118 and a ground engaging system 122.

The power generation system 102 may include an engine 104, a generator 106, and a generator converter 108. The engine 104 could be any engine known in the art, and may be an internal combustion diesel or gasoline engine. In one example, the engine 104 is a diesel powered engine configured to power the electric drive machine 100.

The generator 106 may be associated with a crankshaft on the engine 104 in a manner that the engine 104 drives the generator 106 to create power. When the engine 104 is not running, the generator 106 may be configured to crank the engine crankshaft to start the engine 104. The generator may be sized and selected to provide sufficient power to drive the electric drive machine 100, and also to turn the crankshaft to start the engine 104. The generator converter 108 may be electrically associated with the generator 106 and may be configured to receive energy from the generator 106 and to convert the energy into usable power to operate the electric drive machine 100.

The electric motor system 110 may include a motor converter 112 and an electric motor 114. The motor converter 112 may be configured to convert the power received from the generator converter 108 to a form for powering the electric motor 114. The electric motor system 110 can also be configured to receive power from the ground engaging system 122 of the machine in order to retard or brake the machine. The electric motor 114 could be any electric motor known in the art and may be selected based upon its capacity to drive the electric drive machine 100. In one exemplary embodiment, the electric motor 114 is a variable speed electric motor capable of driving the electric drive machine 100 at a range of different speeds. In another exemplary embodiment, the electric motor 114 may be a reversible motor capable of moving the electric drive machine 100 in both a forward and reverse direction. The electric motor 114 may be connected to the gear train 118 and may be configured to power the gear train 118.

The gear train 118 may be connected to and configured to drive the ground engaging system 122. The ground engaging system 122 may be any system configured to move the electric drive machine 100, and may include wheels or a track system, including gears or sprockets that may be capable of turning the wheels or track.

A DC link 124 may extend between the generator converter 108 and the motor converter 112. The DC link 124 may provide an electrical pathway for the energy generated by the engine 104 to operate and power the electric motor 114. A battery 126 may be selectively connected to the motor converter 112. It may be configured to provide power to the electric motor 114, which in turn may be used to turn the generator 106 to start the engine 104 when the engine 104 is not running. Other systems and accessories on the electric drive machine 100 may also be powered by the battery 126.

Figure 2:
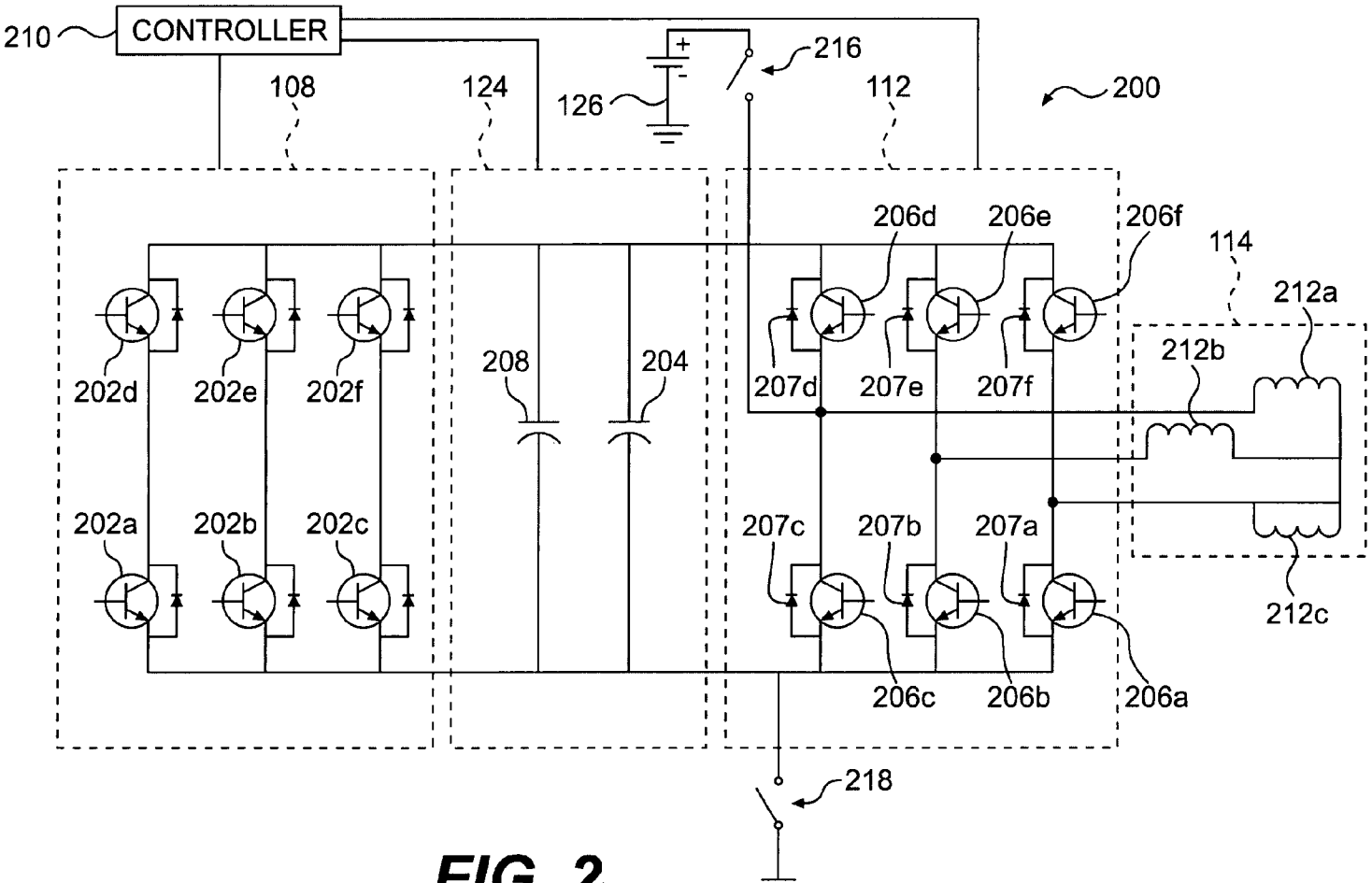
FIG. 2 is a schematic diagram showing components of the electric drive machine of FIG. 1 in accordance with this disclosure.

FIG. 2 shows an exemplary circuit 200 including the generator converter 108, the motor converter 112, the electric motor 114, the battery 126, the DC link 124, and a controller 210. The generator converter 108 may include a set of generator switching elements 202*a*–202*f*. Likewise, the motor converter 112 may include a set of motor converter switching elements 206*a*–206*f*. The switching elements 202, 206 may be semiconductor switching elements such as, for example, insulated gate bipolar transistors (IGBT) or MOSFET switching elements. The switching elements 202, 206 may be opened and closed independent of each other by the controller 210. Each switching element 202, 206 may be associated with a diode configured to control the direction of current flow through the circuit 200. For example, each of the motor converter switching elements 206*a*–206*f* may be associated with diodes 207*a*–207*f*.

The switching elements 202, 206 may be configured so that at least some of the switching elements 202, 206 are divided into pairs of switching elements, with the two switching elements in each pair being arranged in series. For example, switching elements 206*a* and 206*f* form a pair arranged in series. At least some of the pairs of switching elements in the generator converter 108 and the motor converter 112 may be arranged in parallel in the circuit 200.

The controller 210 may be associated with the generator converter 108, the motor converter 112, and the DC link 124, and may be configured to send signals to the sets of switching elements 202, 206. Based upon the signals, the switching elements 202, 206 may be opened or closed to provide power from the generator 106 through the generator converter 108 and the motor converter 112 to power the electric motor 114. The controller 210 may also be associated with the DC link 124, and may be configured to monitor a charge, such as voltage or current, passing through or stored in the DC link 124.

The controller 210 may include a computer having all of the components necessary to run an application, such as, for example, a memory serving as a storage device and a processor serving as a central processing unit. One skilled in the art will appreciate that this computer can contain additional or different components. Furthermore, one skilled in the art will appreciate that operating conditions and/or operating sequences can be stored on or read from other types of computer programs, products, or computer readable media, such as computer chips and secondary storage devices, including hard disks, floppy disks, CD-Roms or other forms of RAM or ROM.

The electric motor 114 may include motor coils 212*a*–212*c* that may be formed of a series of conductive windings that serve as inductors. In one exemplary embodiment, the motor coils 212 are stator windings in the electric motor 114. The stator windings may be configured to drive a rotor (not shown) to power the gear train 118, thereby driving the electric drive machine 100. Circuitry may electrically connect each motor coil 212 between the switching elements that make up the pairs of switching elements 206 discussed above. For example, the motor coil 212*c* is electrically connected between the pair of switching elements 206*a* and 206*f*.

The battery 126 may be connected to the motor converter 112 at a first battery switch 216 and a second battery switch 218. The first battery switch 216 may selectively connect the battery to the motor converter 112 and the electric motor 114, and the second battery switch 218 may selectively connect the motor converter 112 to the negative terminal of the battery 126, possibly through additional conductive components, such as a chassis.

At least one motor coil 212*a* may be directly connected to the battery 126 through the first battery switch 216, bypassing the switching elements 206 in the motor converter 112. Accordingly, the motor coil 212*a* may be configured to receive current from the battery 126 when the first battery switch 216 is closed.

The DC link 124 may include an energy storage device, such as a motor link capacitor 204 and a generator link capacitor 208. These capacitors 204, 208 may be arranged in parallel with the sets of two switching elements, discussed above. Although the energy storage device is described as capacitors 204, 208, the energy storage device could be any other component capable of storing energy. Further, although the energy storage device is described as part of the DC link 124, it could also be considered part of the motor converter 112 and/or the generator converter 108, or alternatively, separate from the DC link 124, the motor converter 112, and the generator converter 108.

In one exemplary embodiment, the generator converter 108 may be capable of receiving power from the DC link 124 and converting the power in a manner to drive the generator 106 to turn the engine 104, thereby starting the engine 104. In order to be started, the engine 104 may require a voltage higher than the voltage provided by the battery 126 itself. In one example, the engine 104 may require a voltage output of 100 volts, for example, to be started by the generator 106. However, the battery 126 may be a 24-volt battery, for example. Accordingly, the circuit 200 may be configured to boost the battery power using the coils 212 in the electric motor 114. The method described with reference to FIG. 3 may be used to boost the battery power using the coils 212 in the electric motor 114 to start the engine 104.

INSUSTRIAL APPLICABILITY

Figure 3:
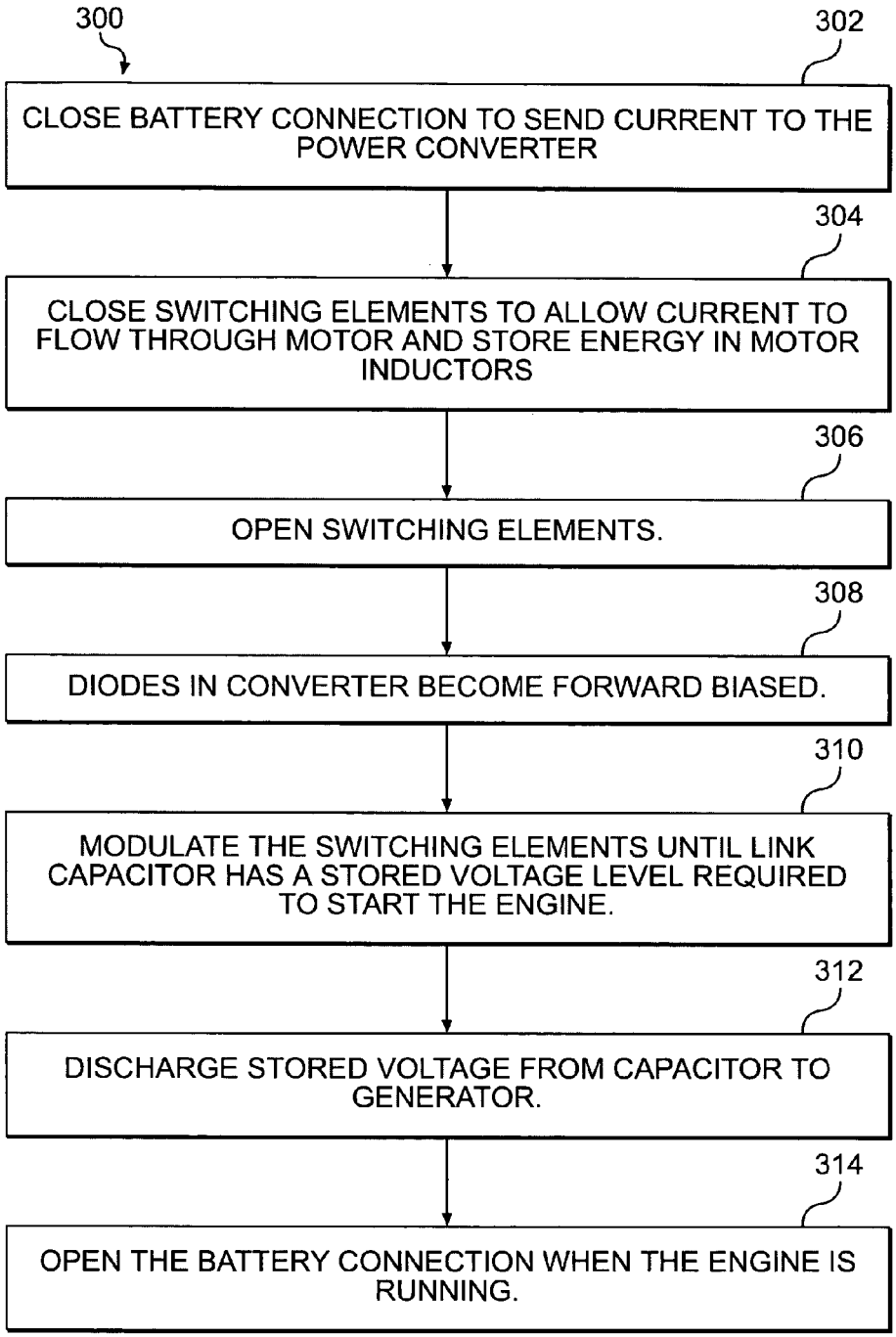
FIG. 3 is a flow chart showing an exemplary method of starting the engine of FIG. 1.

The flow chart 300 of FIG. 3 shows one exemplary method of boosting power from the battery 126 to provide a voltage to the generator 106 that is higher than the battery voltage in order to start the engine 104. This method allows the engine 104 to be started without requiring the use of a separate starter or a separate power booster. The flow chart 300 shows exemplary steps for performing the method to start the engine 104.

At a step 302, the controller 210 may close the first and second battery switches 216, 218, thereby connecting the battery 126 to the motor converter 112. At a step 304, the controller 210 may close the switching elements 206*a* and 206*b* to complete a circuit through the motor converter 112 and the electric motor 114 and to start current flowing. By closing the switching elements 206*a* and 206*b*, current flows from the battery 126 directly to the motor coils 212. The current continues to flow through the motor coils 212 and through the switching elements 206*a* and 206*b* and through the second battery switch 218. In the circuit 200, energy is stored in the coils 212 of the electric motor 114. Other combinations of components may be used to store energy in the coils 212. For example, the motor coil 212*a* could be connected between switching elements 206*e* and 206*b*. In this case, switching elements 206*c* and 206*a* would be activated to complete the circuit. Other combinations are contemplated and included within the scope of this disclosure.

After a period of time, or alternatively, when the motor coils 212 contain a sufficient amount of energy as determined by the controller 210, the controller 210 may open the switching elements 206*a* and 206*b*, at a step 306. This may cause energy stored in the motor coils 212 to forward bias the diodes 207*e* and 207*f* in the switching elements 206*e* and 206*f*, thereby allowing the energy from the coils 212 to be released through the diodes 207*e* and 207*f* to the generator link capacitor 208 and the motor link capacitor 204, for storage at a step 308. The diode 207*c* may also become forward biased, allowing current to flow through it and the link capacitors 204, 208 to complete the circuit from the coils 212 to the link capacitors 204, 208.

At a step 310, the controller 210 may repeat the closing and opening of the switching elements 206*a* and 206*b* to send additional energy to the link capacitors 204, 208, as described with reference to step 304, step 306, and step 308. By repeating or modulating the switching elements 206*a* and 206*b*, energy from the coils 212 may accumulate into the link capacitors 204, 208. Accordingly, the closing and opening of the switching elements 206*a* and 206*b* may be repeated until the voltage level in the link capacitors 204, 208 is sufficient to start the engine 104. In one exemplary embodiment, the voltage level in the link capacitors 204, 208 may be monitored by the controller 210 to determine when it is sufficient to start the engine 104. In another exemplary embodiment, the controller 210 may be configured to modulate the switching elements 206*a* and 206*b* for a set number of times to increase the voltage level.

When adequate voltage is stored in the link capacitors 204, 208, the switching elements 202 in the generator inverter 108 may be opened or closed to discharge the accumulated voltage from the link capacitors 204, 208 at a step 312. The generator converter switching elements 202 may be operated in a manner known in the art to provide power to turn the generator 106 and start the engine 104. Accordingly, the engine 104 may be started using energy that has been stored in the motor coils 212 and held within the link capacitors 204, 208. Once the engine 104 is running, the first and second battery switches 216, 218 may be opened to disconnect the battery 126 from the motor converter 112, at a step 314. At this point, the motor and generator system may be reconfigured for normal machine operation and energy from the engine 104 may be used to drive the electric motor 114.

Figure 4:
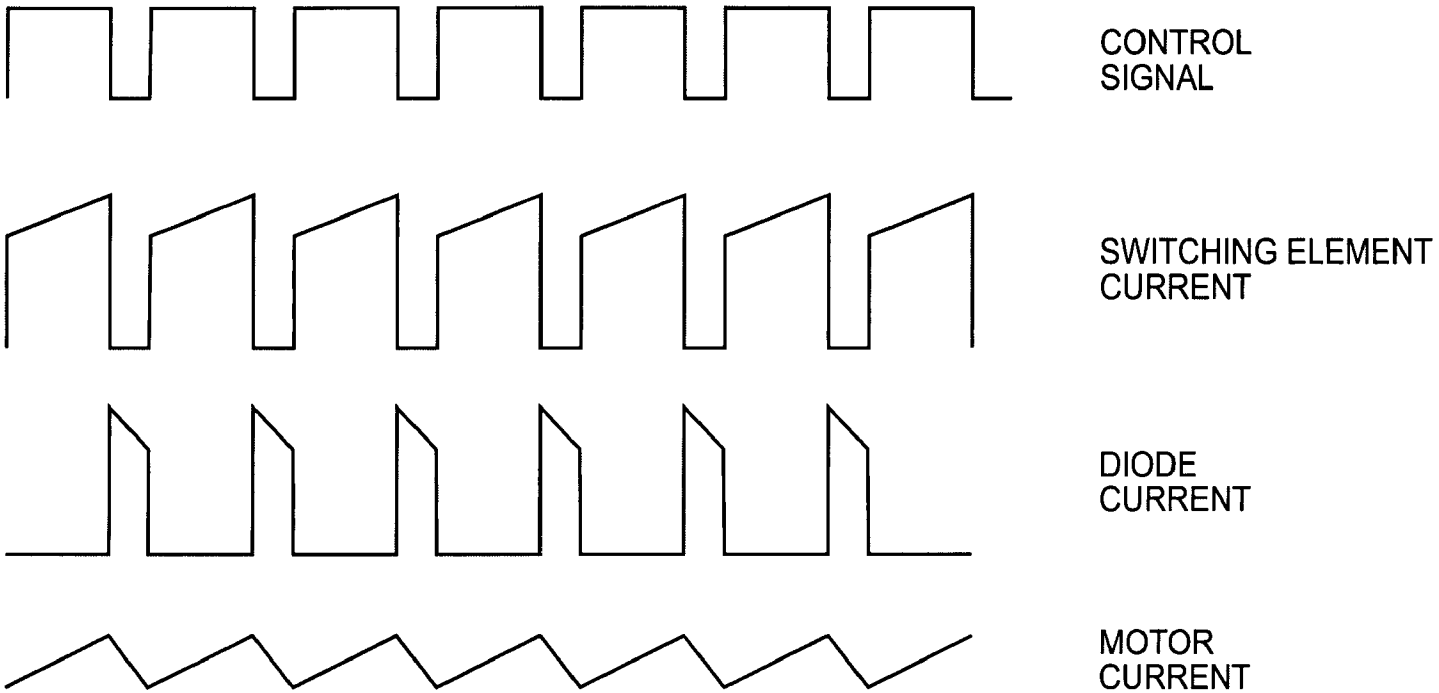
FIG. 4 is a diagrammatic illustration of wave forms of current through components of the circuit of FIG. 2.

FIG. 4 shows exemplary wave forms associated with the circuit 200 while performing the method described in the flow chart 300. More specifically, FIG. 4 shows the effect of the modulating on the current in the switching elements 206*a* and 206*b*, the diodes 207*c*, 207*e*, and 207*f*, and the motor current. The "Control Signal" waveform represents the control signal sent by the controller 210 to the switching elements 206*a* and 206*b* to open and close them. The "Switching Element Current" waveform and the "Diode Current" waveform represent current through the switching elements and diodes, respectively. The "Motor Current" waveform is the summation of the switching element current and the diode current, and represents current to the motor coils 212.

In the Control Signal waveform, the switching elements 206*a* and 206*b* are closed when the waveform is high, and open when the waveform is low. When the wave form is high, the current through the switching elements 206*a* and 206*b* immediately increases to a given level, and continues to gradually increase as shown in the Switching Element Current waveform. As the current level through the switching elements increases, the motor current also increases, as shown in the Motor Current waveform.

When the controller opens the switching elements 206*a* and 206*b*, as shown by the low sections in the Control Signal waveform, current stops flowing through the switching elements as shown in the Switching Element Current waveform. Instead, current flows through the diodes 207*c*, 207*e*, and 207*f* as shown in the Diode Current waveform, gradually decreasing as the current flows through the diodes out of the coils 212 and into the DC link 124. Accordingly, the motor current also decreases. When the motor current is depleted, the switching elements 206*a* and 206*b* may be closed again, thereby providing current through the switching elements 206*a* and 206*b* to the motor coils 212.

As the switching elements 206*a* and 206*b* are modulated on and off, the current from the motor coils 212 accumulates in the link capacitors 204, 208 until the link capacitors 204, 208 have a sufficient level of voltage to start the engine 104 through the generator 206.

Performing the method disclosed herein boosts the voltage provided by the battery 126 without requiring additional components, such as a separate starter or a separate power booster to start the engine 106. Because the electric motor 114 performs the dual function of driving the electric drive machine 100 and boosting the battery power level to provide energy to start the engine 104, manufacturing costs are reduced, and maintenance costs for a starter or separate booster are eliminated.

It will be apparent to those skilled in the art that various modifications and variations can be made in the disclosed system and method without departing from the scope of the invention. Other embodiments of the invention will be apparent to those skilled in the art from consideration of the specification and practice of the invention disclosed herein. It is intended that the specification and examples be considered as exemplary only, with a true scope of the invention being indicated by the following claims and their equivalents.

What is claimed is:

1. A method for starting an engine of an electric drive machine, comprising:

introducing current to an electric motor system from a battery;

receiving the current into at least one coil on an electric motor of the electric motor system, the electric motor being configured to drive the electric drive machine when operating, using a controller to control releasing the energy from the at least one coil to an energy storage device; and using the controller to control discharging the voltage from the energy storage device to a power generation system to start the engine.

2. The method of claim 1, further including accumulating energy from the at least one coil in the energy storage device.

3. The method of claim 2, further including repeating the receiving and releasing steps until the accumulated voltage in the energy storage device is at a level sufficient to start the engine.

4. The method of claim 1, further including operating switching elements in the electric motor system to direct current to the at least one coil and to release the energy from the at least one coil.

5. The method of claim 1, wherein the at least one coil is a stator winding in the electric motor.

6. The method of claim 1, further including storing the current from the battery in the at least one coil to increase an energy level in the at least one coil.

7. The method of claim 6, further including directing the energy from the at least one coil to the energy storage device through switching elements in a motor converter of the electric motor system.

8. The method of claim 1, wherein discharging the voltage from the energy storage device includes directing the voltage through switching elements in a generator converter of the power generation system.

9. A system for starting an engine of an electric drive machine, comprising:

a power generation system;

an electric motor system including an electric motor having at least one coil and configured to drive the electric drive machine when operating, the electric motor system being electrically associated with the power generation system;

a battery selectively associated with the electric motor system and configured to introduce current to the electric motor system; and a controller configured to control the release of energy from the at least one coil in the electric motor to an energy storage device and configured to control the discharge of voltage from the energy storage device to the power generation system to start the engine.

10. The system of claim 9, wherein the energy storage device is configured to accumulate energy from the at least one coil to a level sufficient to start the engine.

11. The system of claim 9, further including switching elements in the electric motor system, wherein the controller is configured to operate the switching elements to direct current to the at least one coil and to release the energy from the at least one coil.

12. The system of claim 11, wherein the switching elements are one of IGBT and MOSFET switches.

13. The system of claim 9, wherein the at least one coil is a stator winding in the electric motor.

14. The system of claim 9, wherein the energy storage device is configured to accumulate energy released from the at least one coil, and store the accumulated energy until the energy level is high enough to start the engine.

15. The system of claim 14, wherein the power generation system includes:

a generator; and a generator converter having switching elements operable to receive voltage from the energy storage device, the generator converter being configured to provide the voltage to the generator to start the engine.

16. The system of claim 9, wherein the electric motor system includes switching elements in a motor converter, the switching elements being configured to activate the accumulation of current in the at least one coil, and configured to activate the release of energy to the energy storage device.

17. The system of claim 16, wherein the controller is configured to modulate the switching elements to accumulate the energy in the at least one coil and release the energy to the energy storage device.

18. An electric drive machine, comprising:

an engine;

a generator associated with the engine and configured to generate power when driven by the engine and to turn the engine to start the engine when the engine is shut down;

a generator converter associated with the generator;

an electric motor converter associated with the generator converter;

an electric motor associated with the electric motor converter, the electric motor having at least one stator winding configured to operate as a coil, the electric motor being configured to drive the electric drive machine when operating;

a battery selectively associated with the electric motor converter and configured to introduce current to the at least one stator winding of the electric motor;

an energy storage device electrically disposed between the generator converter and the electric motor converter; and a controller configured to control the release of energy from the at least one stator winding in the electric motor to the energy storage device and configured to control the discharge of voltage from the energy storage device to the generator converter to turn the generator and start the engine.

19. The electric drive machine of claim 18, wherein the energy storage device is configured to accumulate energy from the at least one stator winding to a level sufficient to start the engine.

20. The electric drive machine of claim 18, further including switching elements in the electric motor converter, wherein the controller is configured to operate the switching elements to direct current to the at least one stator winding and to release the energy from the at least one stator winding.

21. The electric drive machine of claim 20, wherein the controller is configured to modulate the switching elements to accumulate energy in the at least one stator winding and release the energy to the energy storage device.

* * * * *